United States Patent [19]

Perne et al.

[11] 4,305,516

[45] Dec. 15, 1981

[54] BOTTLE CAP WITH GUARANTEE STRIP

[75] Inventors: Raymond Perné, Morance; Philippe Odet, Saint Georges de Reneins, both of France

[73] Assignee: Astra Plastique, Saint Georges de Reneins, France

[21] Appl. No.: 142,597

[22] Filed: Apr. 22, 1980

[30] Foreign Application Priority Data

Apr. 27, 1979 [FR] France ..... 79 11670

[51] Int. Cl.[3] ..... B65D 41/34

[52] U.S. Cl. ..... 215/252

[58] Field of Search ..... 215/252, 256

[56] References Cited

U.S. PATENT DOCUMENTS

| | | | |
|---|---|---|---|
| 3,463,341 | 8/1969 | Fields | 215/252 |
| 3,737,064 | 6/1973 | Patel | 215/252 |
| 3,904,062 | 9/1975 | Grussen | 215/252 |

FOREIGN PATENT DOCUMENTS

| | | | |
|---|---|---|---|
| 553475 | 2/1958 | Canada | 215/252 |
| 2439414 | 3/1976 | Fed. Rep. of Germany . | |
| 2349509 | 11/1977 | France . | |
| 2395909 | 1/1979 | France . | |
| 628172 | 11/1961 | Italy | 215/252 |
| 422557 | 4/1967 | Switzerland | 215/252 |

*Primary Examiner*—Donald F. Norton

*Attorney, Agent, or Firm*—Dowell & Dowell

[57] ABSTRACT

The invention relates to a cap provided with a guarantee strip for stoppering receptacles with a threaded neck, wherein the guarantee strip is formed by at least two separate elements connected to the base of the skirt of the cap by two bosses, of which one, is located ahead of the other as the cap is screwed on and is more resistant than the other, said one boss being severed when the cap is unscrewed. The invention is particularly applicable to the stoppering of bottles of sparkling beverages.

1 Claim, 4 Drawing Figures

BOTTLE CAP WITH GUARANTEE STRIP

The present invention relates to caps, for stoppering bottles or the like, entirely made of moulded synthetic material and provided with a guarantee strip adapted to guarantee the genuineness of the contents of the receptacle until first use thereof, and it concerns more particularly devices of this type which are adapted to be screwed on the threaded necks of bottles containing beverages or other liquids under gaseous pressure.

It is known that, with a view to maintaining the tightness of the stopper despite the pressure exerted on the caps, the said caps have to be made of a very rigid synthetic material having little elastic deformability. The base of the cylindrical wall of such a cap is made integral, via a connecting zone having low resistance to tear, with a guarantee strip made with a diameter slightly smaller than that of said wall so as to bear, by one or more inner protuberances, against the lower edge of the annular shoulder or ring of the bottle located below the thread of the neck.

This strip must therefore be deformed when the cap is screwed, on in order to pass over the bottle ring and clip elastically therebeneath at the end of installation. As the synthetic material is not very deformable, the zone of connection must be sufficiently resistant to avoid any risk of untimely tearing during the screwing on operation. However, this resistance must be overcome by the consumer when opening the bottle for the first time. Contradictory conditions are encountered which are awkward in practice, and result in caps of the above-mentioned type rarely operating satisfactorily for to the consumers since they are either too fragile and tear when being installed, or are too strong so that it is very difficult to open them.

It is a particular object of the improvements according to the present invention to remedy this drawback and to enable a threaded cap with guarantee strip to be produced which responds particularly well to the various desiderata of the art.

The cap according to the invention is of the type constituted by a one-piece body comprising on the one hand a cylindrical skirt threaded internally to cooperate with threads on the corresponding receptacle, and on the other hand a guarantee strip provided at the base of said skirt and comprising at least one strip element of substantially circular section connected to the skirt by at least two vertical bosses, said strip element being intended to clip, at the end of the screwing action, beneath the shoulder or ring of the receptacle in order to hold the cap in place until the recipient is used for the first time. This invention is characterised in that the two connecting bosses have unequal resistances to tear or severance, the boss of greater resistance being the one disposed at the front of the strip when the cap is rotated in the direction to screw of the cap on the receptacle.

The invention will be more readily understood on reading the following description with reference to the accompanying drawings, in which.

Figure 1:
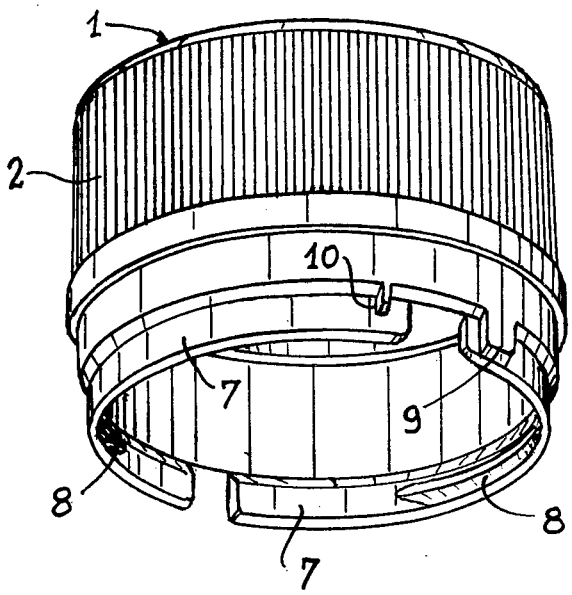
FIG. 1 is a view in perspective of a bottle cap according to the invention.
Figure 2:
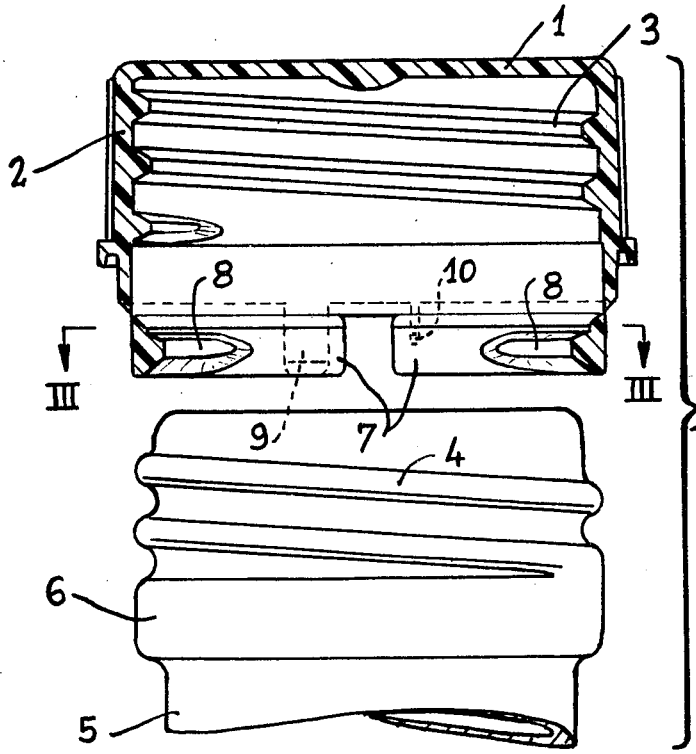
FIG. 2 is an axial section through this cap, shown above the threaded neck of the corresponding bottle.
Figure 3:
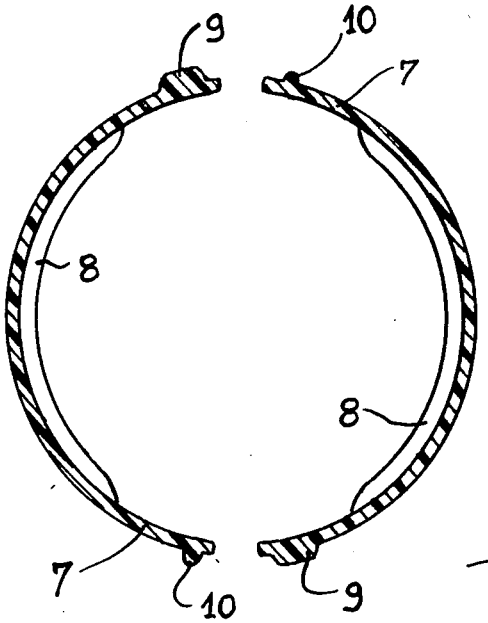
FIG. 3 is a horizontal section along III—III (FIG. 2).
Figure 4:
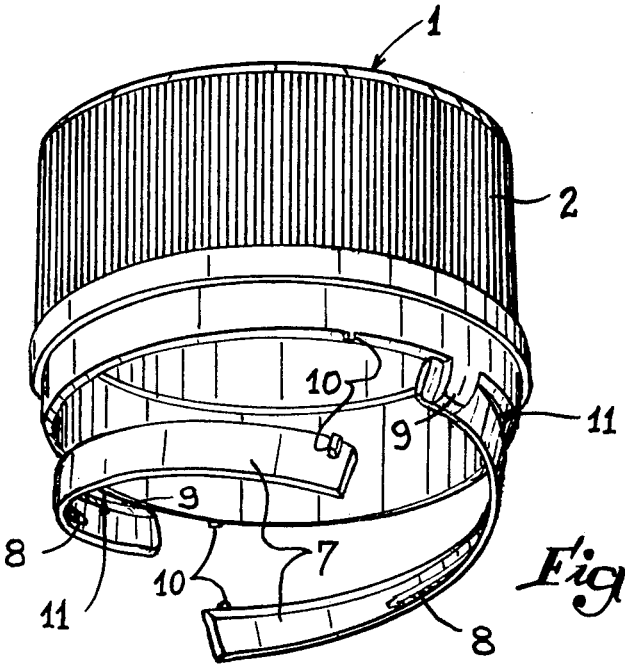

FIG. 4 reproduces FIG. 1, but shows the cap after unscrewing.

Referring now to the drawings, the cap shown in the Figures is manufactured in one piece, obtained by moulding a relatively rigid synthetic material such as polypropylene or the like. The body conventionally comprises a transverse end 1 of circular section, extended downwardly by a cylindrical skirt 2 whose inner wall is provided with a thread 3. The latter is adapted to cooperate with the thread 4 provided on the neck 5 of the bottle, above the usual ring 6 of said neck. Of course, the end 1 may be provided with a flat seal or may comprise a cylindrical funnel, said seal or funnel being intended to ensure the tightness of the stopper.

In accordance with the invention the guarantee strip, provided at the base of the skirt 2 with a view to cooperating with the ring 6, is constituted by strip elements 7, two in number in the embodiment shown, of semi-circular section whose radius is slightly less than that of the skirt 2, so that said elements project inwardly beyond the inner face of said skirt. This projection is further accentuated by a projection 8 provided on the inner wall of each of the elements 7.

It will be noted that the thickness of material is virtually interrupted between the lower edge of the skirt 2 and the upper edge of each of the strip elements 7. The latter are made fast with the skirt 2 by two vertical bosses 9 and 10 provided at the ends of each element 7. Each boss 9 is located near the front loading end of a strip element 7 as the cap is screwed on the neck 5, and, has a width and height much greater than those of the opposite boss 1), with the result that each boss 9 in fact constitutes a very resistant bridge whilst each of the bosses 10 acts, on the contrary, as a connecting lug which may easily be severed.

It will be understood that, when the cap is positioned on the neck 5 after the bottle has been filled, the guarantee strip formed by the two strip elements 7 must obviously pass over the ring 6; this passage necessarily involving deformation of the strip since the projections 8 define a diameter clearly smaller than the outer diameter of said ring. This deformation must take place without the elements 7 risking being severed due to the fact that the tractive force which occurs during installation is borne by the "large" boss 9 of each of said strip elements, the "small" boss 10 near the trailing end of each strip element as the cap is screwed on not being subjected to any exceptional force. As in the guarantee conventional caps of this type, the strip 7—7 occupies a certain axial position at the end of screwing, on such that the projections 8 have clipped beneath the ring 6, their upper edge being disposed beneath the lower edge of said ring. This guarantee strip, clearly visible to the customer on the neck 5, shows that the bottle still contains its initial contents, without any possibility of substitution.

When it is desired to open the bottle, the cap is unscrewed in the conventional manner. However, this rotation is obviously accompanied by an axial displacement which is, in principle, opposed by the projections 8 bearing against the lower edge of the ring 6. This opposing effect produces a tractive force on each element 7 which is therefore displaced obliquely and deformed, until each boss 10 yields by tearing. The cap is then released and may be removed; but, from now on, such removal as illustrated in FIG. 4, is shown by the fact that the elements 7 of the strip are oriented helically and downwardly. It will be readily appreciated that if such a cap is screwed back on the neck 5, the helical spread of the elements 7 indicates clearly that the bottle has been opened before; the coefficient of elastic deformability having been exceeded by oblique displacement of each element prior to severing of the bosses 10. It is impossible to arrange for the elements 7 to "stick" again on the base of the skirt 2: the triangular gap 11 of FIG. 4 is permanent.

The preceding description has been given only by way of example and the replacement of details of execution described, by any other equivalents, will not limit the scope of the invention. The number of elements 7 which form the guarantee strip may obviously vary, particularly as a function of the diameter of the cap.

What is claimed is:

1. In a cap for stoppering receptacles which have a neck with a threaded portion and an annular ring therebelow, the cap comprising a semi-rigid plastic one-piece body including a transverse end and a cylindrical skirt internally threaded to engage said threaded portion of the receptacle, and the body including guarantee strip means attached to the skirt and surrounding and underlying the annular ring, the improvement comprising the structure wherein:

said guarantee strip means comprise plural arcuate strip elements each extending part-way around the ring and each terminating end-to-end with the next strip element, each strip element having near the one of its ends which leads as the cap is screwed onto the neck a first boss extending from the strip element to the skirt and integrally joining the element with the skirt and having a second boss near its other end which extends from the strip element to the skirt, and the first boss being thicker and more resistant to tear than the second boss; and each strip element having a projection extending inwardly therefrom to underlie the ring when the cap is screwed on the neck, each projection being shorter in annular extent that the annular spacing between the first and second bosses of the element whereby the bosses remain untorn while the cap is being screwed on, and each projection being shaped to underlie the ring and provide sufficient tractive force to break the second boss when the cap is being screwed off the neck.

* * * * *